US008900689B2

(12) United States Patent
Ohara et al.

(10) Patent No.: US 8,900,689 B2
(45) Date of Patent: Dec. 2, 2014

(54) METHOD FOR PRODUCING RESIN PLATED PRODUCT AND RESIN MOLDED PRODUCT TO BE PLATED USED THEREFOR

(75) Inventors: Yoshitaka Ohara, Aichi-ken (JP); Tomohiro Morita, Aichi-ken (JP); Ryoji Matsuoka, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 1773 days.

(21) Appl. No.: 12/003,953

(22) Filed: Jan. 3, 2008

(65) Prior Publication Data

US 2008/0311354 A1 Dec. 18, 2008

(30) Foreign Application Priority Data

Jan. 5, 2007 (JP) ..... 2007-000702

(51) Int. Cl.

| | |
|---|---|
| ***B23B 27/04*** | (2006.01) |
| ***C25D 5/56*** | (2006.01) |
| ***C25D 5/12*** | (2006.01) |
| *C25D 5/14* | (2006.01) |
| *C25D 5/48* | (2006.01) |

(52) U.S. Cl.

CPC .. *C25D 5/12* (2013.01); *C25D 5/14* (2013.01); *C25D 5/48* (2013.01)

USPC ..... 428/194; 205/167

(58) Field of Classification Search

CPC ..... C25D 5/12; C25D 5/14; C25D 5/48

USPC ..... 205/50–333; 428/194

See application file for complete search history.

(56) References Cited

U.S. PATENT DOCUMENTS

| | | | | |
|---|---|---|---|---|
| 3,907,624 A * | 9/1975 | Gravely, Jr. | ..... | 156/214 |
| 5,630,928 A | 5/1997 | Ogisu et al. | | |
| 7,045,213 B2 * | 5/2006 | Straus | ..... | 428/412 |

FOREIGN PATENT DOCUMENTS

| | | | | |
|---|---|---|---|---|
| JP | A-54-159341 | 12/1979 | | |
| JP | A-62-060889 | 3/1987 | | |
| JP | A-62-173726 | 7/1987 | | |
| JP | A-62-219407 | 9/1987 | | |
| JP | 02-030792 | * 2/1990 | ..... | C25D 5/56 |
| JP | A-02-030792 | 2/1990 | | |
| JP | A-3-45968 | 4/1991 | | |

(Continued)

OTHER PUBLICATIONS

Human Translation of JP 02-030792.*

(Continued)

*Primary Examiner* — Gerard Higgins
*Assistant Examiner* — Sathavaram I Reddy
(74) *Attorney, Agent, or Firm* — Posz Law Group, PLC

(57) ABSTRACT

A method for producing a resin plated product includes: a molding step of forming a resin molded product as a resin molded product to be plated that includes integrally a main body part with a form of a molding and a sacrifice part arranged in the vicinity of an edge part not to come into contact with the edge part; an electro-less plating step of applying an electro-less plating process to the resin molded product, an electroplating step of immersing the resin molded product in an electroplating bath provided with an anode electrode, applying an anode voltage to the anode electrode and applying a cathode voltage to the resin molded product to carry out an electroplating process; and a removing step of removing the sacrifice part from the resin molded product. The sacrifice part is preferably extended from a non-designed surface of the main body part.

5 Claims, 9 Drawing Sheets

(56) References Cited

FOREIGN PATENT DOCUMENTS

| | | | |
|---|---|---|---|
| JP | B-17570 | | 4/1992 |
| JP | A-06-238717 | | 8/1994 |
| JP | A-7-228992 | | 8/1995 |
| JP | 2001-303292 | A | 10/2001 |
| JP | A-2002-337190 | | 11/2002 |
| JP | A-2006-249492 | | 9/2006 |

OTHER PUBLICATIONS

Office Action mailed Aug. 22, 2011 in corresponding JP application No. 2007-000702 (and English translation).

Office Action dated Jul. 17, 2014 in corresponding Indian Application No. 30/DEL/2008.

* cited by examiner

METHOD FOR PRODUCING RESIN PLATED PRODUCT AND RESIN MOLDED PRODUCT TO BE PLATED USED THEREFOR

BACKGROUND OF THE INVENTION

1. Field of the Invention

The present invention relates to a method for producing a resin plated product by applying an electroplating process to a resin molded product having an edge part and a resin molded product to be plated used for this method.

2. Related Art

When the resin plated product is produced, an electro-less plated thin film is formed on the surface of a resin molded product, and then, an electroplated thick film is formed by carrying out a plurality of processes. The resin plated product to which such plating processes are applied shows metallic luster depending on the kinds of plating components.

When an electroplating process is carried out, the resin molded product is held by a jig, immersed in an electroplating bath having an anode electrode, an anode voltage is applied to the anode electrode and a cathode voltage is applied to the resin molded product through the jig.

The resin molded product such as a molding for decorating a vehicle body includes an edge part having a relatively long form and sharp in the shape of an acute angle at an end. When the electroplated film is formed in the resin molded product having such an edge part, an electric charge in electroplating solution is liable to be concentrated to the edge part. Therefore, a quantity of plating deposited on the edge part is increased and the thickness of a plated film in the edge part is larger than that of other part. For instance, when the thickness of an electroplated film of other part than the edge part is 50 μm, the thickness of an electroplated film of the edge part may be sometimes possibly 100 μm or more. When the thickness of the plated film of the edge part is increased as described above, an external appearance of the product is deteriorated.

In order to solve the above-described problem, usually, for instance, JP-UM-A-3-45968, JP-A-2006-249492 and JP-UM-B-4-17570 disclose that an auxiliary cathode is provided in a jig and the auxiliary cathode is arranged in a plating bath in the vicinity of an edge part of a resin molded product.

Further, JP-A-7-228992 discloses that both right and left end parts of an anode electrode are covered with a resin shield plate of an L shape in section in an electroplating bath to shield the concentration of a current from the anode electrode to both the end parts of a resin molded product.

However, in JP-UM-A-3-45968, JP-A-2006-249492 and JP-UM-B-4-17570, as the number of times of using the jig is increased more, a large quantity of an electroplated film sticks to the auxiliary cathode formed in the jig. The electroplated film sticking to the auxiliary cathode is hardly completely peeled off from the auxiliary cathode. Accordingly, when the jig is taken in and out from a plating bath, the plated film falls from the auxiliary cathode and platting metal powder thereof adheres to a resin plated product, resulting in the deterioration of the external appearance of the resin plated product.

Further, the resin shield plate of JP-A-7-228992 is L shaped in section and large in its width. Since the resin shield plate is not electrically conductive, a plated film is not deposited. Therefore, when the resin shield plate is taken out from a plating bath, plating liquid remains on the resin shield plate. Accordingly, during moving the resin shield plate, the plating liquid remaining on the resin shield plate drops. Thus, plating liquid components stick to a resin plated product, so that the external appearance of the product may be sometimes deteriorated.

SUMMARY OF THE INVENTION

The present invention is devised by considering the above-described circumstances and it is an object of the present invention to provide a method for producing a resin plated product by which when an electroplating process is applied to a resin molded product having an edge part, an electroplated film having a uniform thickness can be formed and an inferior appearance due to the drop of plating metal powder can be prevented and a resin molded product to be plated used for this method.

(1) The invention that solves the above-described problems provides a method for producing a resin plated product having an edge part by using an electroplating method. The method for producing a resin plated product comprises: a molding step of forming a resin molded product to be plated that includes a main body part having a form of the resin plated product and a sacrifice part extending from the main body part and arranged in the vicinity of the edge part not to come into contact with the edge part; an electric conductivity applying step of applying an electric conductivity to the surface of the resin molded product to be plated; an electroplating step of immersing the resin molded product to be plated in an electroplating bath provided with an anode electrode, applying an anode voltage to the anode electrode and applying a cathode voltage to the resin molded product to be plated to carry out an electroplating process; and a removing step of removing the sacrifice part from the resin molded product to be plated.

The resin molded product to be plated includes integrally the main body part having the form of the resin plated product and the sacrifice part arranged in the vicinity of the edge part not to come into contact with the edge part. The sacrifice part is provided with a prescribed space relative to the edge part so as not to come into contact with the edge part. When the cathode voltage is applied to the resin molded product to be plated during an electroplating process, the sacrifice part formed integrally with the main body part in the resin molded product to be plated is electrified with a minus electric charge together with the main body part to become an auxiliary electrode. Therefore, plus electric charges of metal components dissolved in electroplating solution are collected to the periphery of the sacrifice part so that the concentration of the electric charges to the edge part can be suppressed. Accordingly, the concentrated deposition of the plating on the edge part can be suppressed to form a plated film having a uniform thickness.

Further, the sacrifice part is removed from the resin molded product to be plated after the electroplating process. Therefore, the sacrifice part is not exposed to the plating process many times. Thus, there is no fear that the plated film is excessively deposited. Accordingly, there is no possibility that plating metal power falls and sticks to the resin plated product to deteriorate its external appearance.

(2) Further, the invention for solving the above-described problems provides a resin molded product to be plated having an edge part to which an electroplating process is applied. The resin molded product to be plated comprises: a main body part having a form of a resin plated product and the edge part; and a sacrifice part extending from the main body part and arranged in the vicinity of the edge part not to come into contact with the edge part.

The resin molded product to be plated integrally includes the main body part having the form of the resin plated product and the sacrifice part arranged in the vicinity of the edge part so as not to come into contact with the edge part. Accordingly, when the resin molded product to be plated is immersed in the electroplating bath and the cathode voltage is applied to the resin molded product, the sacrifice part formed in the resin molded product to be plated becomes an auxiliary cathode. Therefore, electric charges in the vicinity of the edge part are collected to the sacrifice part in the electroplating bath so that the concentration of the electric charges to the edge part can be suppressed. Accordingly, the concentrated deposition of plating on the edge part can be suppressed to form a plated film having a uniform thickness.

Further, the sacrifice part is formed integrally with the main body part. Accordingly, a process for producing the auxiliary cathode does not need to be separately carried out differently from a case that the auxiliary cathode is separately provided. Therefore, the number of the increase of production processes can be suppressed.

As described above, according to the present invention, the sacrifice part is formed integrally in the vicinity of the edge part of the main body part having the form of the resin plated product by maintaining a non-contact state with the edge part. Therefore, during the electroplating process, the sacrifice part becomes the auxiliary cathode, so that the concentration of plating to the edge part can be suppressed. Accordingly, can be provided the method for producing a resin plated product by which when the electroplating process is applied to the resin molded product to be plated, the electroplated film having the uniform thickness can be formed without an inferior external appearance due to the drop of the plating metal powder and the resin molded product to be plated used for this method.

DETAILED DESCRIPTION OF THE PREFERRED EMBODIMENTS

In the present invention, a resin molded product to be plated includes a main body part having an edge part and a form of a resin plated product and a sacrifice part extending from the main body part.

The "edge part" is an end part of the main body part having the form of a resin plated product and means a part having a possibility that the thickness of a plated film may be formed to be larger than that of other part by an electroplating process. When the main body is flat in its form, in the edge part having an end part sharp to an acute angle, an electroplated film thicker than other part is liable to be formed.

Figure 1:
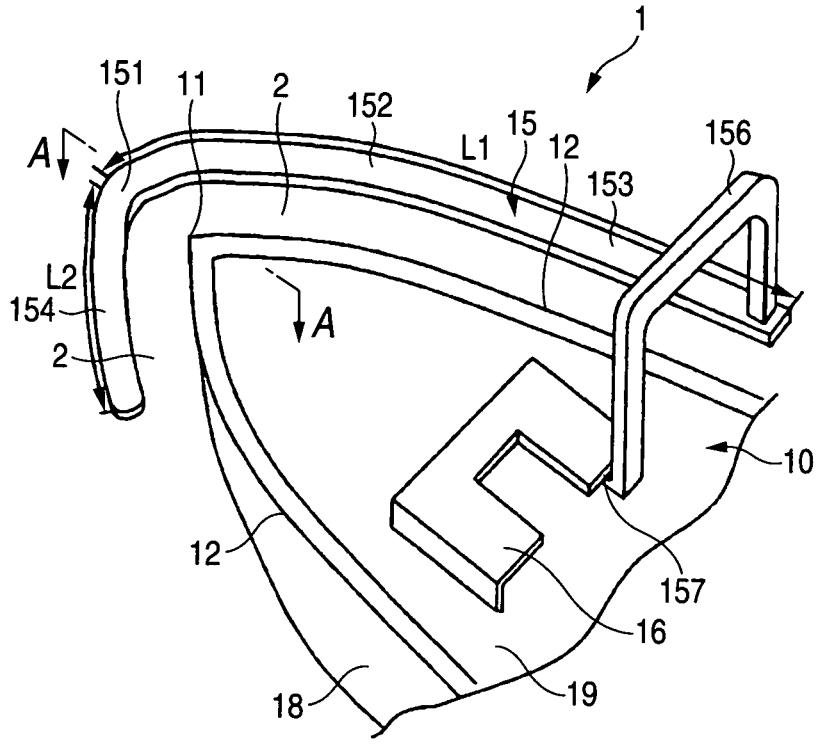
FIG. 1 is a perspective view of a part in the vicinity of an edge part of a resin molded product to be plated according to a first embodiment.
Figure 8:
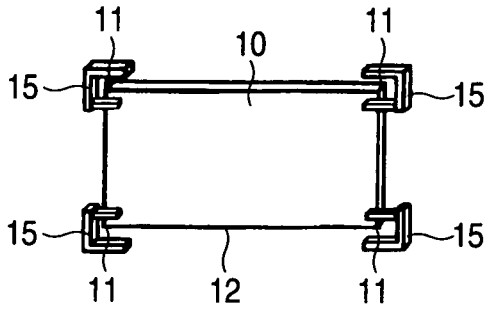
FIG. 8 is a perspective view of the resin molded product to be plated that has a plate shaped main body part in the present invention.
Figure 9:
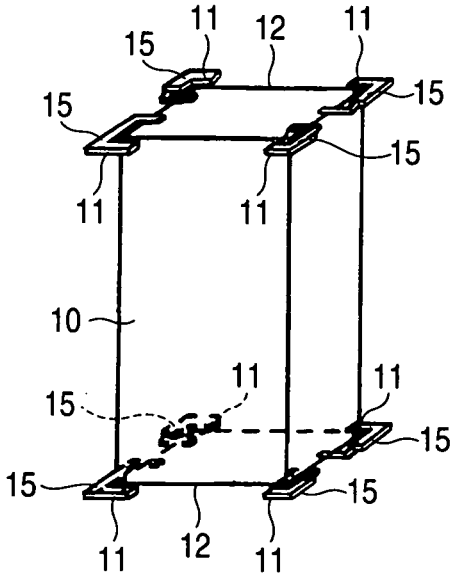
FIG. 9 is a perspective view of the resin molded product to be plated that has a square pole shaped main body part in the present invention.
Figure 10:
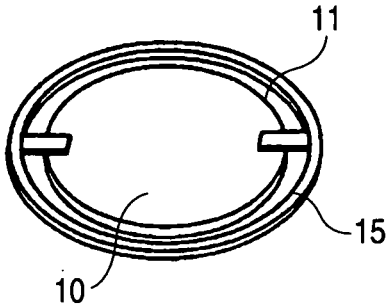
FIG. 10 is a perspective view of the resin molded product to be plated that has a disk shaped main body part in the present invention.
Figure 11:
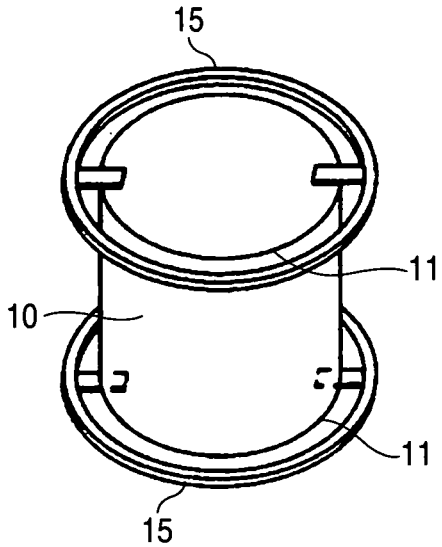
FIG. 11 is a perspective view of the resin molded product to be plated that has a cylindrical main body part in the present invention.

FIG. 1 and FIGS. 8 to 11 exemplify examples of the resin molded products to be plated having various kinds of forms and show the edge parts in which the electroplated films thicker than other parts are apt to be formed. As shown in FIG. 1, when the resin molded product to be plated has a main body part 10 of a boat shape like the molding of parts of a motor vehicle, sharp parts at both ends thereof are edge parts 11. As shown in FIG. 8, when the main body part 10 has a plate shape, corner parts formed at four parts thereof are edge parts 11. As shown in FIG. 9, the main body part 10 is a square pole shaped body, corner parts formed at eight parts thereof are edge parts 11. As shown in FIG. 10, the main body 10 has a disk shape, a ring shaped edge part thereof is an edge part 11. As shown in FIG. 11, the main body 10 has a cylindrical body shape, ring shaped edge parts at both ends of a side surface thereof are edge parts 11. The main bodies shown in FIGS. 8 and 9 have square shapes, however, the main body may have other polygonal forms such as a triangular form, a pentagonal form or the like.

The sacrifice part is formed integrally with the main body part so as to be arranged in the vicinity of the edge part. The sacrifice part does not come into contact with the edge part.

Figure 14:
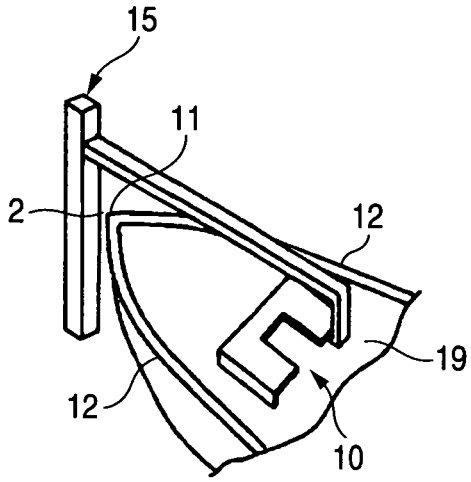
FIG. 14 is a perspective view of the resin molded product to be plated that has the main body part of a molding and a liner shaped sacrifice part linearly extending vertically to a plane formed by the peripheral edge part of an edge part.
Figure 15:
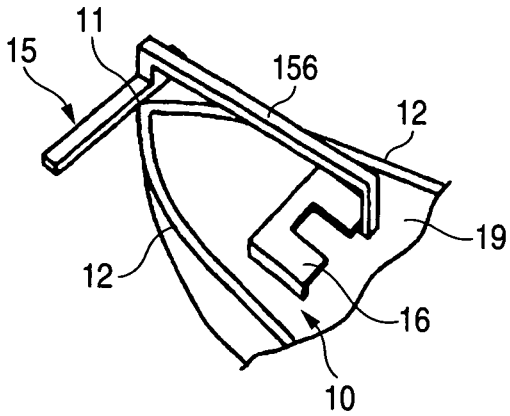
FIG. 15 is a perspective view of the resin molded product to be plated that has the main body part of a molding and a liner shaped sacrifice part linearly extending in parallel with a plane formed by the peripheral edge part of an edge part.

As shown in FIGS. 1, 8 and 9, when the main body part 10 has a peripheral edge part 12 of the edge part 11, the sacrifice part 15 is formed along, for instance, the form of the peripheral edge part 12 of the edge part 11 and holds a prescribed space 2 between the peripheral edge part 12 of the edge part 11. As shown in FIGS. 14 and 15, the sacrifice part 15 may be formed so as to come nearest to the edge part 11 of the main body part 10 and separate remotely from the edge part 11. In this case, as shown in FIG. 14, the sacrifice part 15 may extend vertically to a plane formed by the peripheral edge part 12. Further, as shown in FIG. 15, the sacrifice part 15 may extend in a direction parallel to a plane formed by the peripheral edge part 12.

Figure 13:
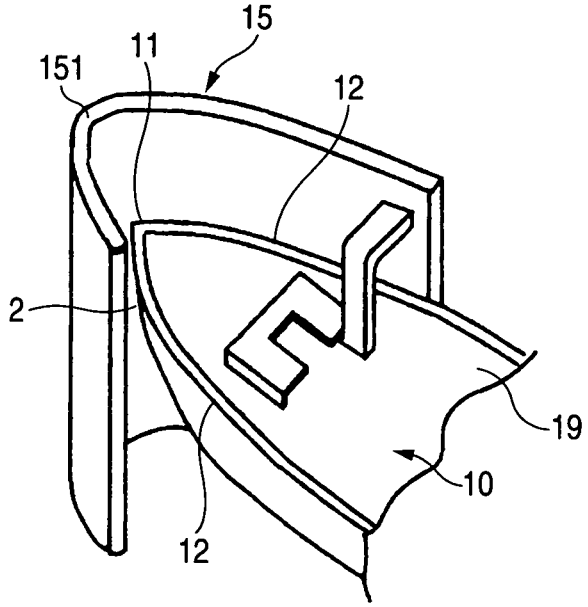
FIG. 13 is a perspective is a perspective view of the resin molded product to be plated in which the main body part is a molding and a sacrifice part is connected to two parts of the main body part.

As shown in FIG. 1, the sacrifice part 15 has, for instance, a liner shape. Further, as shown in FIG. 13, the sacrifice part 15 may have a wide plate shape. Further, as shown in FIG. 1, the sacrifice part 15 preferably has a proximity part 151 nearest to the edge part 11 formed in a bent part. Thus, electric charges are liable to be concentrated to the bent proximity part. Thus, the concentration of the electric charges of the edge part can be effectively suppressed.

Figure 12:
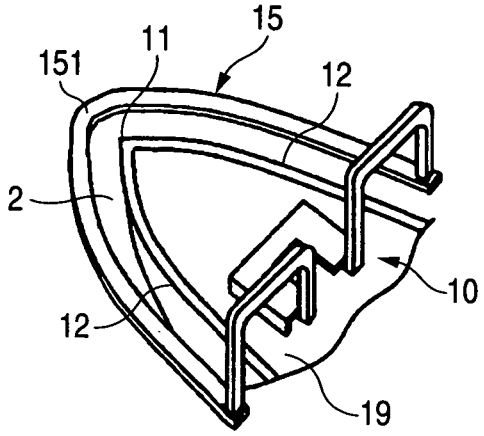
FIG. 12 is a perspective view of the resin molded product to be plated in which the main body part is a molding and a sacrifice part is connected to two parts of the main body part.
Figure 16:
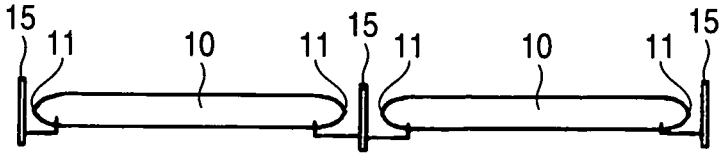
FIG. 16 is a perspective of the resin molded product to be plated in which the main body part is a molding and two main body parts are connected together through the sacrifice part.

As shown in FIGS. 1 and 8 to 11, the sacrifice part 15 may be extended from one part of the main body part 10. Further, as shown in FIG. 12, the sacrifice part 15 may be extended from two parts of the main body part 10. Further, as shown in FIG. 16, a plurality of main body parts 10 may be connected together through the sacrifice part 15.

A distance between the edge part and a part of the sacrifice part corresponding to the edge part is preferably 3 to 15 mm. When the distance is smaller than 3 mm, there is a fear that the sacrifice part comes into contact with the edge part. When the distance exceeds 15 mm, an effect for suppressing the concentration of the electric charges to the edge part by the sacrifice part is lowered, so that there is a possibility that the thickness of a plated film of the edge part may be increased. Further preferably, the distance between the edge part and the part of the sacrifice part corresponding to the edge part is 5 to 7 mm. Thus, the thickness of the plating of the edge part can be made to be substantially the same as that of other part.

The sacrifice part preferably has a length of 1 cm or more from the part corresponding to the edge part. When the length is less than 1 cm, there is a fear that the concentration of the electric charges to the sacrifice part is decreased to increase the thickness of the plated film of the edge part. An upper limit of the length of the sacrifice part from the part corresponding to the edge part is not especially limited. However, when the sacrifice part has a form along the form of the periphery of the edge part, the length is preferably 10 cm or less. When the length exceeds 10 cm, other part than the edge part in which the thickness of a plated film is not large is also enclosed by the sacrifice part. Thus, there is a possibility that the thickness of the plated film of the peripheral part of the edge part may be decreased.

The sacrifice part is preferably extended from a non-designed surface of the resin molded product to be plated. The sacrifice part is removed after the electroplating process, so that a mark may remain after the sacrifice part is removed. The sacrifice part is extended from the non-designed surface, so that the mark after the sacrifice part is removed remains on the non-designed surface and an external appearance of a designed surface is not deteriorated.

Figure 4:
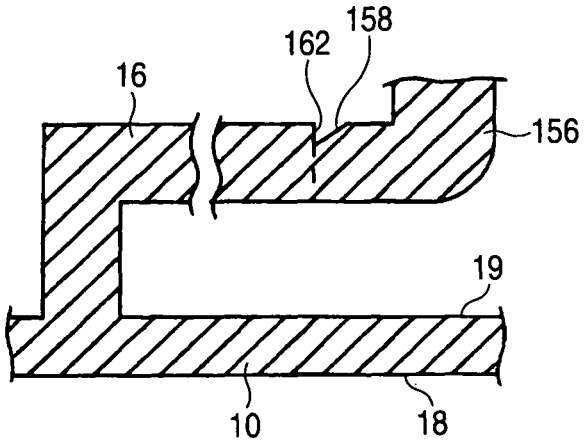
FIG. 4 is a sectional view of a connecting part extended from an attaching seat of a main body part of the first embodiment and having a recessed part in the vicinity of a boundary part to the attaching seat.

As shown in FIG. 4, a boundary part of the sacrifice part 15 relative to the main body part 10 may have a recessed part 158. Thus, the sacrifice part can be easily folded, and accordingly, the sacrifice part can be easily removed.

The sacrifice part 15 may be extended from an opening end face 162 of an attaching seat 16 provided in the main body part 10. In this case, the recessed part 158 is formed in the upper part of the opening end face 162 of the attaching seat 16.

Figure 5:
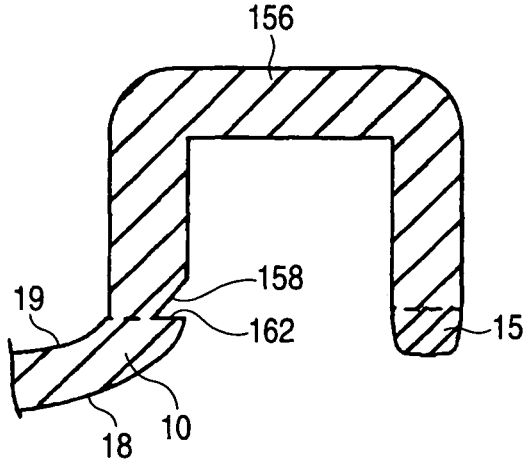
FIG. 5 is a sectional view of the connecting part extended from the main body part of the first embodiment and having the recessed part in the vicinity of a boundary part to the main body part.

Further, as shown in FIG. 5, the sacrifice part 15 may be extended directly from the main body part 10. In this case, the recessed part 158 is formed in, for instance, a boundary part relative to a designed surface 19 of the main body part 10.

The resin molded product to be plated can be formed by using various kinds of resin materials such as an ABS (acrylonitrile. butadiene. styrene) resin, polypropylene, polyphenylene oxide, polyamide, polysulfone, polyester, and PC/ABS (polyca ABS alloy).

The resin molded product to be plated can be formed together with the sacrifice part by various kinds of molding methods such as a metal mold forming method, an injection molding method, an extrusion molding method, a vacuum molding method or the like.

To the resin molded product to be plated, a cathode voltage is applied during the electroplating process. Therefore, an electric conductivity needs to be applied to the resin molded product to be plated before the electroplating process. In such an electric conductivity applying process, for instance, a chemical (electro-less) plating process is applied to the resin molded product to be plated. Further, an electric conductive material may be mixed in a material of the resin molded product to be plated.

In the electroplating process, one or two kinds of plating components such as copper, nickel, chromium or the like are used to form an electroplated film. The electroplated film can be formed with one plating layer or two or more plating layers.

The present invention may be employed for producing the resin plated products, for instance, outer parts for a vehicle such as a molding, a radiator grill, a back door garnish, an emblem, inner parts for a vehicle such as a register knob, cock parts, domestic electric parts, play parts, etc.

(Embodiment)

An embodiment of the present invention will be described by referring to the drawings.

Figure 2:
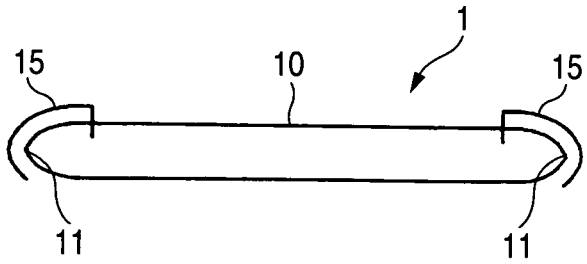
FIG. 2 is an entire explanatory view of the resin molded product to be plated according to the first embodiment.

A resin plated product of this embodiment is a molding mounted on a motor vehicle as shown in FIGS. 1 and 2 and has edge parts 11 at both ends thereof. In the resin plated product, a plated film is applied to a resin molded product made of an ABS resin to show metallic luster. A front side of the resin plated product is a designed surface 18 and a back surface is a non-designed surface 19. The resin plated product is fixed to a side surface or a front surface of a vehicle body by inserting a clip to an attaching seat 16 formed on the non-designed surface 19.

Figure 7:
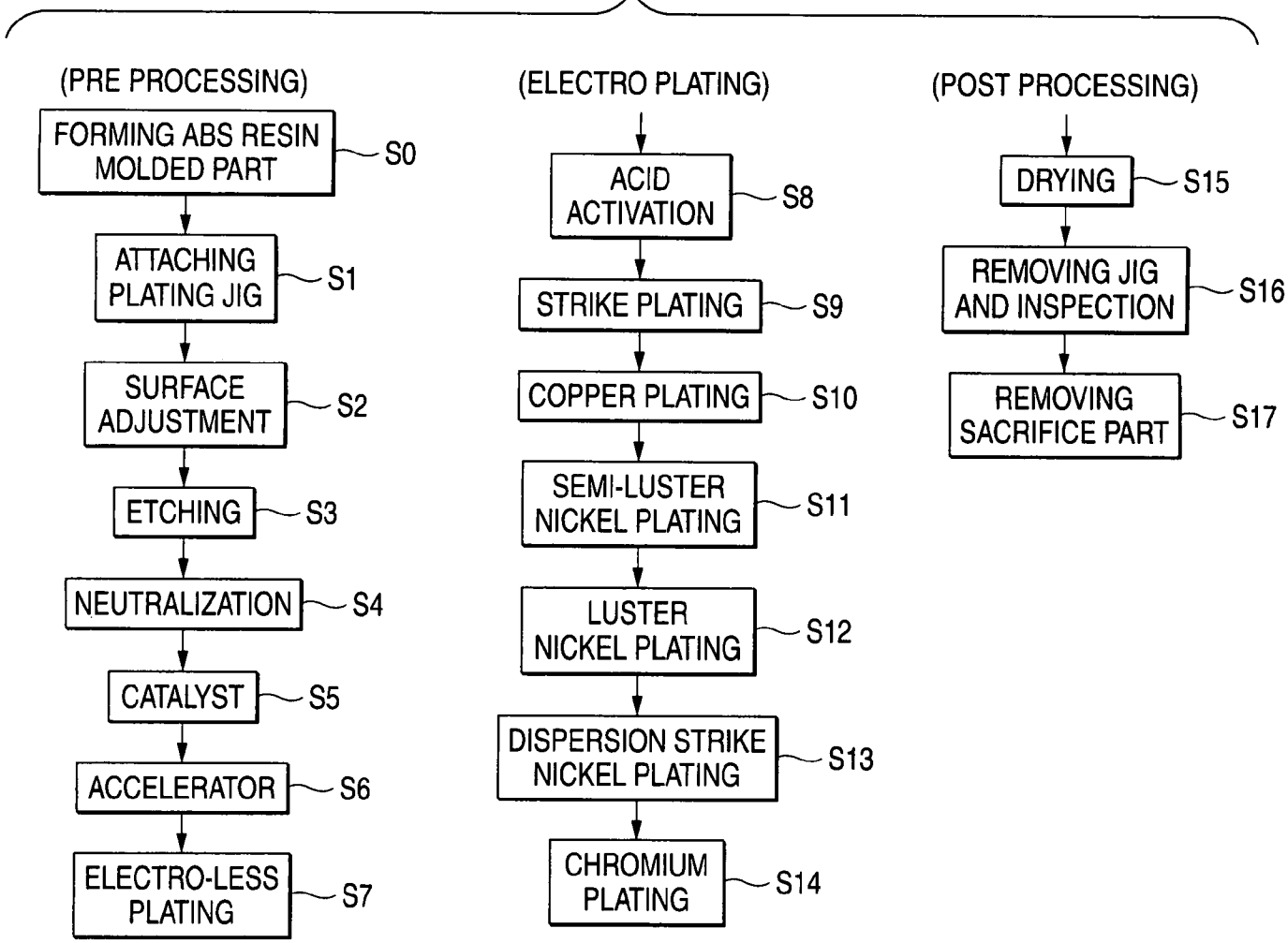
FIG. 7 is an explanatory view showing producing processes of a resin plated product of the first embodiment.

Now, a method for producing the resin plated product will be described by referring to a process diagram shown in FIG. 7.

Figure 3:
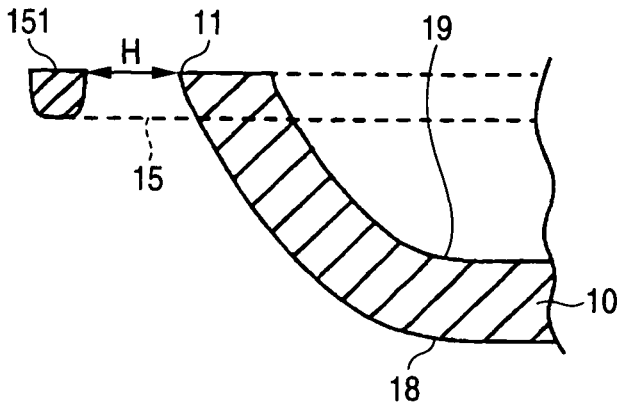
FIG. 3 is a sectional view taken along a line A-A of FIG. 1.

Initially, as shown in FIGS. 1 to 3, a resin molded product 1 is formed that integrally includes a main body part 10 having a form of a molding and a sacrifice part 15 arranged in the vicinity of the edge part 11 so as not to come into contact with the edge part 11 (S0). The resin molded product 1 is a resin molded product to be plated to which a subsequent electroplating process is applied. The resin molded product 1 is formed by using the ABS resin as a material and a metal mold.

The main body part 10 of the resin molded product 1 has a form of an elongated boat and is provided with sharp edge parts 11 at both ends.

The sacrifice part 15 of the resin molded product formed integrally with the main body part 10 so as to be arranged in the vicinity of the edge part 11. The sacrifice part 15 does not come into contact with the edge part 11. The sacrifice part 15 is extended from one part of the non-designed surface 19 of the main body part 10.

The sacrifice part 15 is extended from the attaching seat 16 formed on the non-designed surface 19 of the main body part 10. As shown in FIG. 4, in a boundary part of the sacrifice part 15 relative to the main body part 10, a recessed part 158 is provided. The sacrifice part 15 has a connecting part 156 bent in an inverted U shape in the direction separating from the non-designed surface 19 of the main body part 10 and a liner part 152 extended along the outer form of a peripheral edge part 12 of the edge part 11 from the connecting part 156 by holding a space 2 of 5 to 7 mm from the peripheral edge part 12. The liner part 152 has an elongated line form with the width of 5 to 7 mm and the thickness of 3 to 5 mm.

The liner part 152 includes a proximity part 151 nearest to the edge part 11, and enclosing parts 153 and 154 extending along the form of the peripheral edge part 12 of the edge part 11 from both right and left sides of the proximity part 151. The proximity part 151 is bent to an acute angle along the form of the edge part 11. As shown in FIG. 3, a distance H between the proximity part 151 and the edge part 11 is 5 to 7 mm. As shown in FIG. 1, the length L1 and L2 of the enclosing parts 153 and 154 is 3 to 10 cm. An end part of the one enclosing part 153 is a fixed end connected to the connecting part 156 and an end part of the other enclosing part 154 is a free end.

As shown in FIG. 4, the connecting part 156 is connected to the attaching seat 16 formed on the non-designed surface 19 of the main body part 10. The attaching seat 16 is a part to which the clip for fixing the molding as the main body part 10 to the vehicle body is inserted. To an opening end face 162 of the attaching seat 16, the connecting part 156 is extended. In a boundary part of the connecting part 156 relative to the opening end face 162, a cut-out shaped recessed part 158 opened upward is formed.

Figure 6:
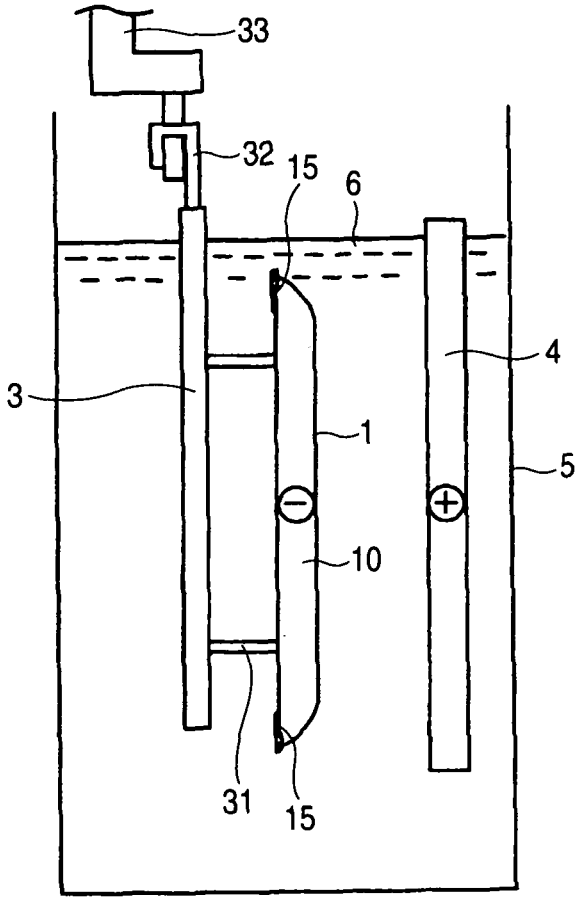
FIG. 6 is an explanatory view of an electroplating bath of the first embodiment.

Then, resin molded product is attached to a jig (S1). As shown in FIG. 6, the jig 3 includes an arm part 31 for gripping and fixing the resin molded product 1, a conveying device 33 for conveying the jig 3 upward and downward and in the direction of a plane and a hook part 32 for connecting the arm part 31 to the conveying device 33. The jig 3 is moved to a prescribed position outside a plating bath 5 by the conveying device 33 to grip and fix the resin molded product 1 to the arm part 31.

Then, below-described surface treatments are respectively applied to the resin molded product together with the jig. Firstly, a surface adjustment is carried out to the resin molded product (S2) to remove contamination such as dust, oil or the like adhering to the surface of the resin molded product. Then, etching liquid is used to etch the resin molded product (S3) so that the surface of the resin molded product is roughened. After that, the surface of the resin molded product is neutralized by acid to reduce and remove hexa-chromium as one of etching components (S4). Then, a catalyst is used (S5). Thus, a catalyst (a Pd—Sn compound) having a strong adsorbing force and a reducing force is allowed to be adsorbed to the roughened surface of the resin molded product. After that, an accelerator is applied to the resin molded product (S6) to remove Sn adhering to the surface of the resin molded product and activate Pd. Then, the resin molded product is immersed in an electro-less plating bath to apply an electro-less plating process to the resin molded product (S7) and form an electro-less plating layer. Thus, an electric conductivity is applied to the surface of the resin molded product.

As shown in FIG. 6, the resin molded product 1 is sequentially immersed in various kinds of electroplating baths 5 together with the jig 3. The electroplating bath 5 is filled with various kinds of plating liquids 6. In the electroplating bath 5, an anode electrode 4 is provided. An anode voltage is applied to the anode electrode 4. Further, to the resin molded product 1, a cathode voltage is applied through the jig 3. Since the electric conductive electro-less plated film is formed on the surface of the resin molded product, the surface of the resin molded product is electrified to a cathode.

In various electroplating processes, an activation with acid (S8), a strike plating process (S9), a copper plating process (S10), a semi-luster nickel plating process (S11), a luster nickel plating process (S12), a dispersion strike nickel plating process (S13) and a chromium plating process are sequentially carried out. Subsequently, a drying process (S15) and a process for removing and inspecting the jig (S16) are carried out. After that, the recessed part 158 of the connecting part 156 is bent by a hand to remove the sacrifice part 15 from the main body part 10 of the resin molded product (S17).

The resin plated product is obtained by the above-described processes.

In this embodiment, as shown in FIG. 1, the resin molded product 1 integrally has the main body part 10 having the form of the resin plated product and the sacrifice part 15 arranged in the vicinity of the edge part 11 of the main body part 10 so as not to come into contact with the edge part 11. The sacrifice part 15 has the prescribed space 2 between the edge part 11 and the sacrifice part 15 so as not to come into contact with the edge part 11. As shown in FIG. 6, during the electroplating process, when the cathode voltage is applied to the resin molded product 1, the sacrifice part 15 formed integrally with the main body part 1 becomes an auxiliary electrode. Therefore, electric charges are collected to the sacrifice part 15 arranged in the vicinity of the edge part 11 in the electroplating bath 5, so that the concentration of the electric charges to the edge part 11 can be suppressed. Accordingly, the concentrated deposition of the plating to the edge part 11 can be suppressed to form a plated film having a uniform thickness.

Further, the sacrifice part 15 is removed from the resin molded product 1 after the electroplating process. Therefore, the sacrifice part is not exposed to the plating process many times so that there is no fear that the plated film is excessively deposited. Accordingly, when the resin molded product is carried by the jig 3, there is no possibility that plating metal powder falls or adheres to the resin plated product to deteriorate the external appearance of the product.

Further, the sacrifice part is integrally formed. Therefore, a process for producing the auxiliary cathode does not need to be separately carried out differently from a case that the auxiliary cathode is separately provided. Accordingly, the increase of the number of producing processes can be suppressed.

The method for producing the resin plated product and the resin molded product to be plated according to the present invention may be also applied to a case for electroplating to cock parts, domestic electric parts and play parts as well as parts of a motor vehicle.

What is claimed is:

1. A resin molded product to be plated having an edge part to which an electroplating process is applied, said resin molded product to be plated comprising:

a main body part having a form of a resin plated product and the edge part, the edge part being arranged at a longitudinal end of the main body part; and a sacrifice part connected to the main body part and not contacting the edge part, wherein the sacrifice part comprises a liner part and a connecting part, wherein the sacrifice part can be negatively charged together with the main body part to become an auxiliary electrode when a cathode voltage is applied to the resin molded product to be plated during the electroplating process, wherein the sacrifice part extends from an attaching seat on a non-designed surface of the main body part, and wherein the connecting part is bent in an inverted U shape in a direction that separates the liner part from the non-designed surface of the main body part.

2. The resin molded product to be plated according to claim 1, wherein the edge part includes a peripheral edge part, and the liner part extends along the periphery edge part at a prescribed distance from the peripheral edge part.

3. The resin molded product to be plated according to claim 1, wherein the distance between the edge part and a proximate part of the liner part nearest to the edge part is 3 to 15 mm.

4. The resin molded product to be plated according to claim 2, wherein the liner part comprises enclosing part extending along the peripheral edge part, and the enclosing parts each have a length of 3 to 10 cm.

5. The resin molded product to be plated according to claim 1, wherein a recess is formed at a boundary between the sacrifice part and the main body part.

* * * * *